US007651035B2

(12) United States Patent
van der Heijden

(10) Patent No.: US 7,651,035 B2
(45) Date of Patent: Jan. 26, 2010

(54) DISPENSING ASSEMBLY

(75) Inventor: Edgar Ivo Maria van der Heijden, Broek Op Langedijk (NL)

(73) Assignee: Airspray N.V., Alkmaar (NL)

( * ) Notice: Subject to any disclaimer, the term of this patent is extended or adjusted under 35 U.S.C. 154(b) by 445 days.

(21) Appl. No.: 11/587,317

(22) PCT Filed: Apr. 21, 2005

(86) PCT No.: PCT/NL2005/000296

§ 371 (c)(1),
(2), (4) Date: Oct. 23, 2006

(87) PCT Pub. No.: WO2005/102539

PCT Pub. Date: Nov. 3, 2005

(65) Prior Publication Data

US 2008/0237261 A1 Oct. 2, 2008

(30) Foreign Application Priority Data

Apr. 23, 2004 (NL) ..... 1026031

(51) Int. Cl.
*B05B 17/00* (2006.01)
*B05B 9/043* (2006.01)

(52) U.S. Cl. ..... 239/1; 239/303; 239/305; 239/333; 239/414; 239/423; 239/432; 239/433; 239/600; 222/135; 222/145.5

(58) Field of Classification Search ..... 239/329, 239/333, 303–305, 414, 423, 424, 432, 433, 239/600, 1; 222/129, 135, 137, 145.5; 604/191
See application file for complete search history.

(56) References Cited

U.S. PATENT DOCUMENTS 3,045,925 A * 7/1962 Giangualano ..... 239/414

(Continued)

FOREIGN PATENT DOCUMENTS

| | | |
|---|---|---|
| EP | 0443519 A2 | 8/1991 |
| FR | 2796925 | 2/2001 |
| WO | WO03/078075 A1 | 9/2003 |

*Primary Examiner*—Steven J Ganey
(74) *Attorney, Agent, or Firm*—Hoffman & Baron, LLP

(57) ABSTRACT

A dispensing assembly (1) has a first (10) and second dispensing unit (20), each of which first and second dispensing units has a reservoir for accommodating a liquid substance as well as a manually operable first and second pump (12, 22), respectively, attached to the reservoir. The dispensing assembly furthermore has a pump operating button assembly for jointly operating the first and second pump, the first pump connecting to a first dispensing duct in the pump operating button assembly (2A, 2B) and the second pump connecting to a second dispensing duct in the pump operating button assembly. The pump operating button assembly has at least one dispensing nozzle which is in communication with at least one dispensing duct in tie pump operating button assembly (2A, 2B) for dispensing one or more dispensing products based on the substances emanating from the first and second dispensing units. For example, at least one of the first and second pumps is a liquid pump which is designed for dispensing liquid to the associated dispensing duct. For example, at least one of the first and second pumps is a foam forming pump which is designed for dispensing a foam to the associated dispensing duct. For example, at least one of the first and second pumps is a liquid pump which is designed for dispensing liquid to the associated dispensing duct, which dispensing duct connects to an atomizing device which is accommodated in the pump operating button assembly in such a manner that a mist can be dispensed from at least one dispensing nozzle of the dispensing assembly.

26 Claims, 8 Drawing Sheets

U.S. PATENT DOCUMENTS 3,236,457 A * 2/1966 Ladd et al. ..... 239/304
4,773,562 A * 9/1988 Gueret ..... 222/135
4,826,048 A 5/1989 Skorka et al.
4,902,281 A 2/1990 Avoy
6,308,863 B1 * 10/2001 Harman ..... 222/135

* cited by examiner

DISPENSING ASSEMBLY

CROSS-REFERENCE TO RELATED APPLICATIONS

This application is the National Stage of International Application No. PCT/NL2005/000296, filed Apr. 21, 2005, which claims the benefit of Netherlands Application No. NL 1026031, filed Apr. 23, 2004, the contents of which is incorporated by reference herein.

FIELD OF THE INVENTION

The invention relates to a dispensing assembly for dispensing one or more dispensing products based on the liquid substances emanating from a first and a second reservoir.

BACKGROUND OF THE INVENTION

A dispensing assembly is for example known from WO 03/078075 by the Applicant.

SUMMARY OF THE INVENTION

It is an object of the present invention to propose alternative embodiments for a dispensing assembly of this type. In particular, it is an object of the invention to propose dispensing configurations with dispensing streams configured for various areas of use and consisting of a combination or mixture of the streams from both reservoirs.

It is a further object of the invention to propose dispensing units which are particularly suitable for dispensing toothpaste, for example in combination with a mouth-freshening mist.

For this purpose, the invention provides a dispensing assembly according to claim 1.

A dispensing assembly of this type can be designed in a variety of attractive ways.

In one possible embodiment, a stream of foam is dispensed in combination with a stream (or a number of part-streams) of liquid. In this case, provision may be made for the liquid to be atomized so that a mist is combined with a foam stream.

In another possible embodiment, a liquid stream is converted into mists, which are then sprayed out simultaneously. In one variant, the liquids from both reservoirs are turned into mists, which are then sprayed out simultaneously. Of course, it is also conceivable to combine the liquids and to atomize them subsequently.

It is also possible to produce a variant in which two foam streams are combined, for example using a mixer, and dispensed by a single dispensing nozzle. The same applies to two liquid streams.

A further aspect of the invention provides a dispensing assembly in which the pump operating button assembly is formed by coupling together, optionally detachably, a first and a second pump operating button which, respectively, are part of the first and second dispensing unit, the first dispensing duct being provided in the first pump operating button and the second dispensing duct being provided in the second pump operating button.

For example, the first and second pump operating buttons form a common space in which an insert is accommodated, which insert has a first inlet which connects to the first dispensing duct in the first pump operating button, and which insert has a second inlet which connects to the second dispensing duct in the second pump operating button, the insert forming one or more dispensing ducts connecting to the first and second inlets thereof and having one or more associated dispensing nozzles.

By using the insert, the production of the dispensing units of different types can be carried out more efficiently. Thus, it is possible to achieve a great diversity of dispensing configurations with one embodiment of the pump operating buttons.

Preferably, the space for accommodating the insert is formed by the first and second pump operating buttons each having a bearing surface for the other pump operating button, the pump operating buttons each having a recess at the bearing surface which forms a part of the space for the insert.

Preferably, the insert fits between the pump operating buttons in a form-fitting manner, in such a way that the insert is secured against displacement by the pump operating buttons being coupled together.

Another aspect of the invention provides in a dispensing assembly in which at least one of the pump operating buttons has a recess at the bearing surface, in such a manner that the recess forms part of a section of the dispensing duct formed by the adjoining pump operating buttons.

In one possible embodiment, one of the pump operating buttons has a protruding part, which extends into the recess of the other pump operating button, the dispensing duct of this respective pump operating button extending through the protruding part and the protruding part forming the dispensing nozzle thereof.

A further aspect of the invention which can be utilized in combination with one or more of the abovementioned aspects of the invention, relates to the dispensation of a dental care agent for oral use by humans or animals.

This aspect of the invention, for example, provides for the dispensing of a dental care agent to be carried out by means of a dispensing assembly as described here.

This aspect offers all kinds of advantageous possibilities for making dental care agent available to the user. For example, a tooth cleaning substance (paste) can be dispensed in combination with a mist, as a result of which, for example, mist drops fall on the exterior of the dispensed amount of substance and act in a refreshing manner in the mouth.

For example, the first pump is a foam-forming pump having a liquid pump part and an air pump part as well as a foam-forming feature where the pumped liquid and air are made to form a foam, and in which the second pump is a liquid pump. In this manner, the dental care agent can thus be dispensed as a combined foam/liquid stream. In this case, the part-streams may be unmixed or mixed. The foam may serve to distribute the dental care agent evenly over the toothbrush. Furthermore, it may serve to prevent excessive use of dental care agent.

The foam may then also consist of a foamable liquid suitable for oral use and the second reservoir may contain a paste containing an abrasive and/or polishing agent. The foamable liquid may, for example, contain fluoride and/or an antiseptic and/or vitamins and/or flavourings and/or colorants.

It is also conceivable for both pumps to be foam-forming pumps or for both pumps to be liquid pumps.

It is also possible for one of the two reservoirs to contain enzymes, such as are being used nowadays to prevent tooth plaque.

DESCRIPTION OF THE DRAWINGS

The various aspects of the invention will now be explained in more detail with reference to the drawing, in which.

DETAILED DESCRIPTION OF PREFERRED EMBODIMENTS

Figure 1:
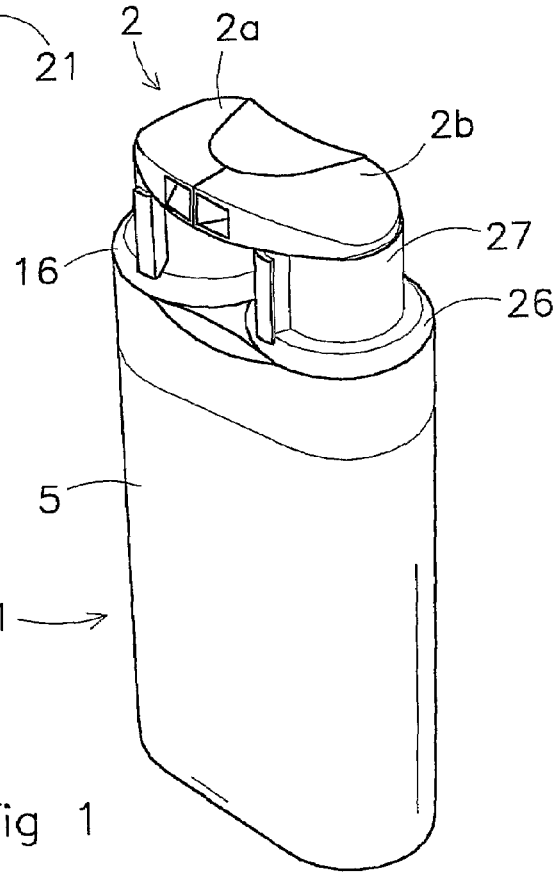
FIG. 1 shows an exemplary embodiment of a dispensing assembly provided with a pump operating button assembly according to the prior art.

FIG. 1 shows a dispensing assembly 1 provided with a pump operating button assembly 2 which is designed according to the prior art. As will be explained in more detail, the invention, inter alia, provides for alternative pump operating buttons.

The dispensing assembly 1 consists of a first dispensing unit 10 and a second dispensing unit 20 in an arrangement next to one another.

The first and second dispensing units 10, 20 each have a reservoir 11, 21 for accommodating a liquid substance as well as a manually operable first and second pump 12, 22, respectively, attached to the reservoir 11, 21 and an associated first and second pump operating button 2*a*, 2*b*, respectively, for dispensing a substance from the reservoir 11, 21.

The pumps 12, 22 can be of a well-known design, for example piston pumps or bellows pumps.

In this example, each reservoir 11, 21 has a dimensionally stable wall with a bottom, a peripheral wall and an opening (preferably designed as a neck with screw thread or other coupling) at the top, into which the housing of the pump 12, 22 fits.

One or both of the reservoirs can also be of the "airless" type, the bottom of the reservoir being at least partly formed by a piston. This piston moves as liquid is being pumped out of the reservoir, in the direction of the pump in order to compensate for the space which was being taken up by the liquid which has been pumped out. It is also possible for one of the two reservoirs to be designed as a "collapsible" reservoir, for example as a bag, optionally as a bag placed inside a housing having a stable wall.

The liquid can be pumped from the reservoir 11, 21 and dispensed by means of the pump 12, 22. The two pumps 12, 22 are operated simultaneously by means of the pump operating button assembly 2 on top of the pump which can be moved up and down. Restoring springs (not shown) associated with each of the pumps cause the assembly 2 to move upwards.

The pumps 12, 22 are secured against displacement on the reservoirs 11, 21 by means of fixing collars 16, 26.

In the embodiment shown, provision is made for both pumps 12, 22 to be foam-forming pumps having a liquid pump part and an air pump part, as well as a foam-forming feature where the pumped liquid and air are made to form a foam.

It will be clear that the dispensing device 1 is suitable to be held in the hand or to be placed on a surface. However, the invention also applies to other embodiments, such as for example one with a wall holder, in which the dispensing nozzles may have a different orientation and may, for example, be at the bottom of the dispensing unit.

Figure 2:
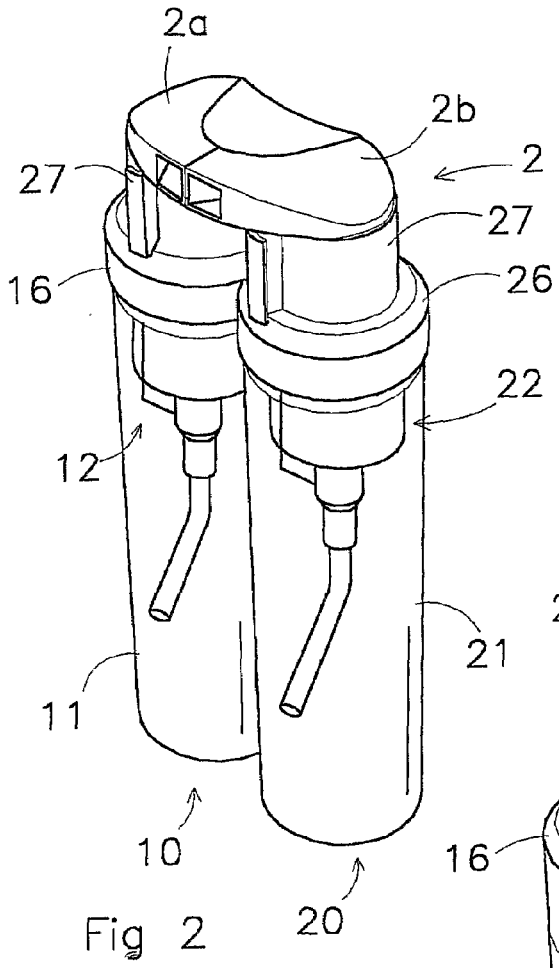
FIG. 2 shows the two reservoirs, pumps and pump operating buttons of the dispensing assembly of FIG. 1 coupled together.

In FIGS. 1 and 2, it can be seen that the dispensing units 10, 20 are arranged next to one another, a holder 5 being shown in FIG. 1 designed as a sleeve with opening(s) at the top into which the reservoirs 11, 21 are inserted. The bottom of the sleeve 5 is, for example, provided with one or more openings, so that the user can press the reservoirs 11, 21 out of the sleeve 5. Provision can also be made for other types of coupling means which connect the reservoirs 11, 21 and/or the pumps 12, 22 directly to one another. The fixing collars 16, 26 are preferably designed to form a snap connection with the holder 5.

If desired, it is possible to produce the holder 5 in two parts, in such a manner that each reservoir 11, 21 can be placed in one of the parts, it being possible to couple the parts to one another, if desired releasably, preferably by means of coupling elements or the like.

In addition, the dispensing units 10, 20 shown in FIGS. 1 and 2 in this example are each provided with a removable locking element 27, which is placed around a section of the pump operating button 2*a*, 2*b* in a clamping manner and thus prevents the pump operating button assembly 2 from being pressed down.

Each pump 12, 22 has a dispensing opening (not shown) for the foam. In this case, the first pump 12 connects to a first dispensing duct 2*c* in the first pump operating button 2*a* and the second pump 22 connects to the second dispensing duct 2*d* in the second pump operating button 2*b*.

These dispensing ducts 2*c*, 2*d* each have a dispensing nozzle situated in a peripheral surface of the respective pump operating button 2*a*, 2*b* which nozzles 2*c*, 2*d* are adjacent. As a result thereof, two streams of foam are dispensed upon operation, which streams adjoin one another, partly due to the dispensing ducts being directed at an angle facing each other near the dispensing nozzles.

Figure 3A:
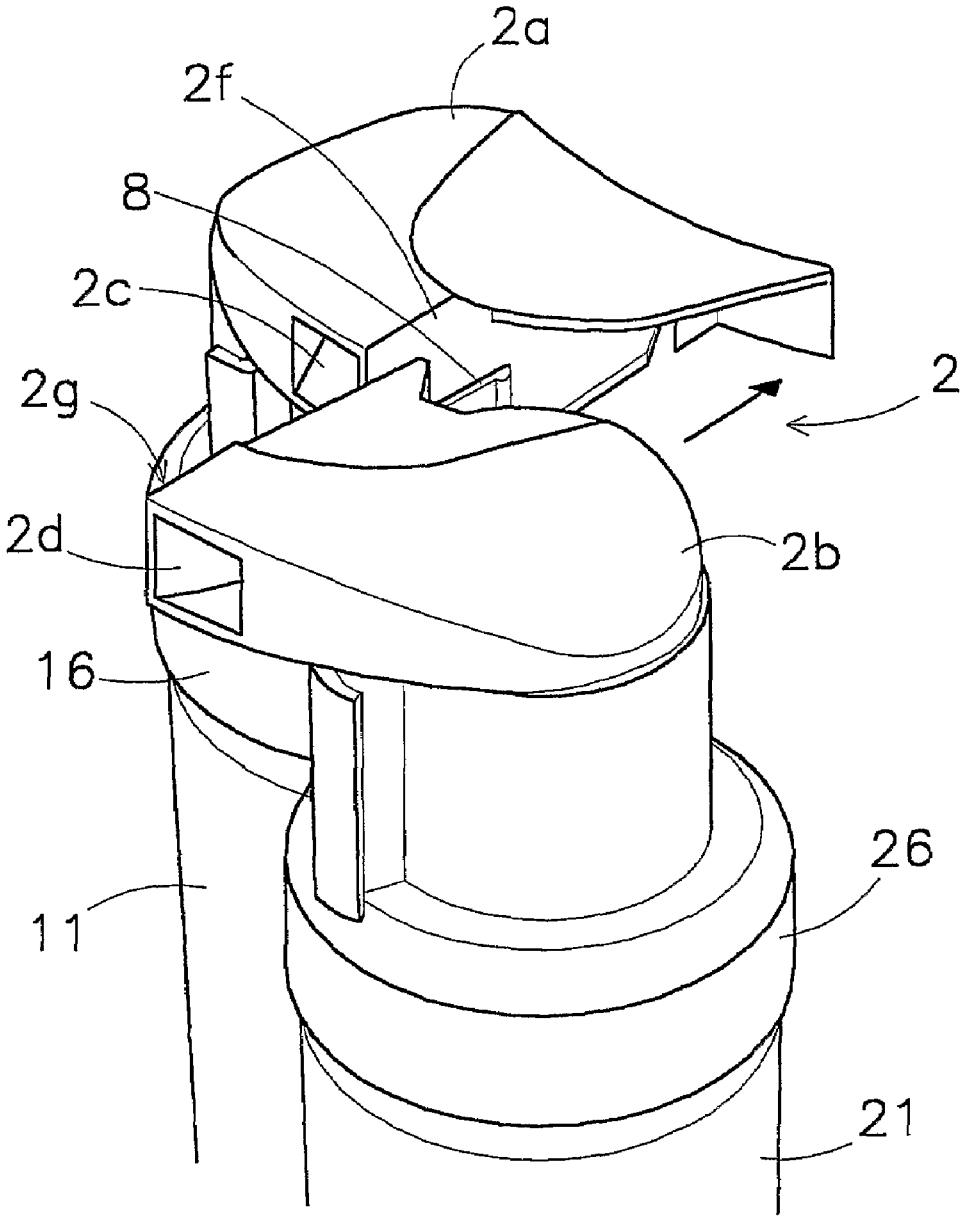
FIG. 3*a* shows the manner in which the pump operating buttons of the dispensing assembly of FIG. 1 are coupled together.
Figure 3B:
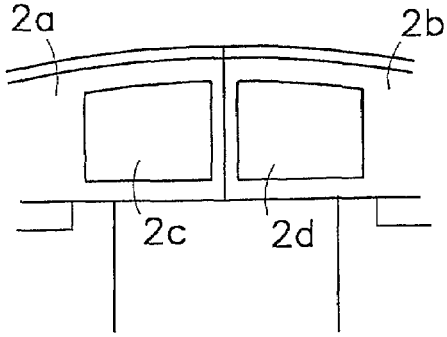
FIG. 3*b* shows the configuration of the dispensing nozzle on the dispensing assembly of FIG. 1.
Figure 8:
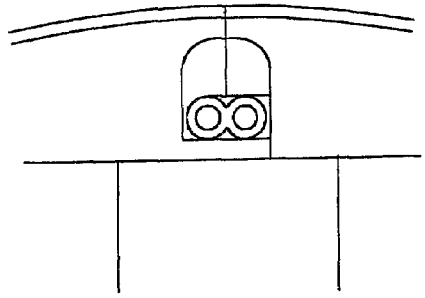
FIG. 8 shows an alternative configuration of the dispensing nozzles.

FIG. 3*b* shows the form and position of the dispensing nozzles of ducts 2*c*, 2*d* of the pump operating button assembly 2.

It can be seen from FIG. 3*a* that the pump operating buttons 2*a*, 2*b* are connected by a sliding movement relative to one another in a direction parallel to the bearing surfaces 2*f*, 2*g* of the respective buttons. In this example, these bearing surfaces are in the imaginary central plane between the pumps of the dispensing units 10, 20. In this case, the button 2*b* is provided with a resilient lip with hook 8, which hooks behind a hooking edge (not shown) of the button 2*a*.

In another embodiment, it is conceivable for the coupling to be effected by means of a different kind of coupling movement, for example by means of a kind of bayonet coupling between the buttons.

An alternative pump operating button assembly 30 will now be explained with reference to FIGS. 4*a*, 4*b*, which assembly 30 can be used at the location of the assembly 2 described previously.

The assembly 30 has a first and second pump operating button 31, 32 which form a common space in which an insert 33 is accommodated. The insert 33 has a first inlet 34 which connects to the first dispensing duct 35 in the first pump operating button 31. Furthermore, the insert 33 has a second inlet 36 which connects to the second dispensing duct 37 in the second pump operating button 32.

Figure 4C:
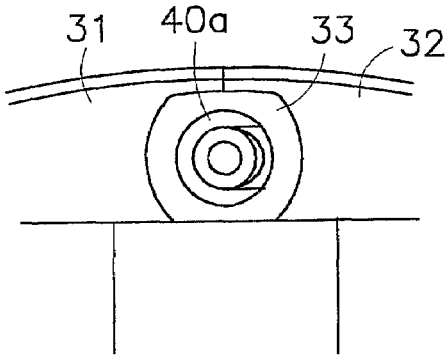
FIG. 4*c* shows the configuration of the dispensing nozzles of the assembly of FIG. 4*a*.
Figure 4A:
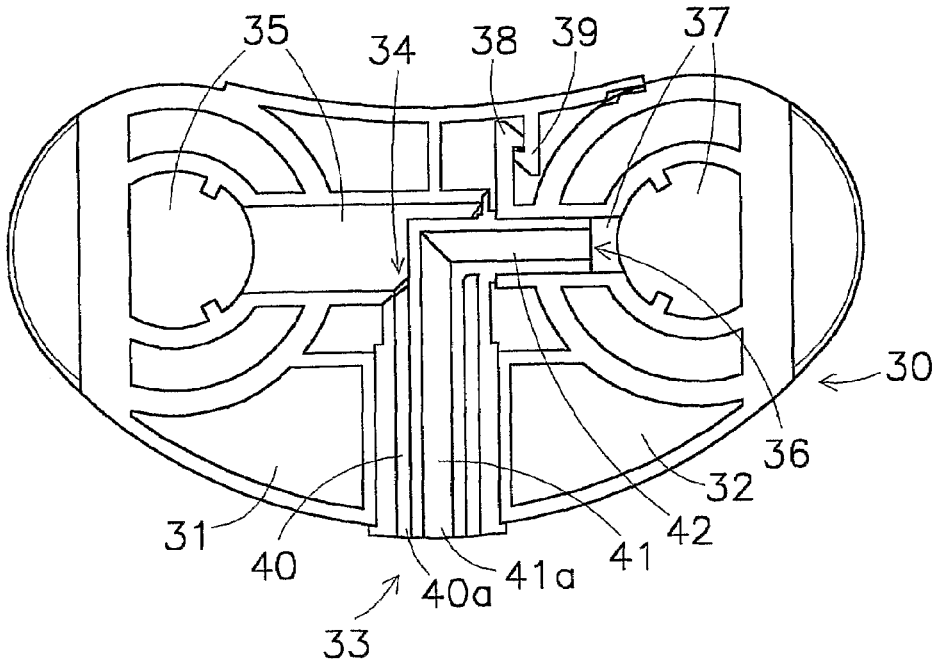
FIG. 4*a* shows a horizontal section through a pump operating button assembly with insert.
Figure 4B:
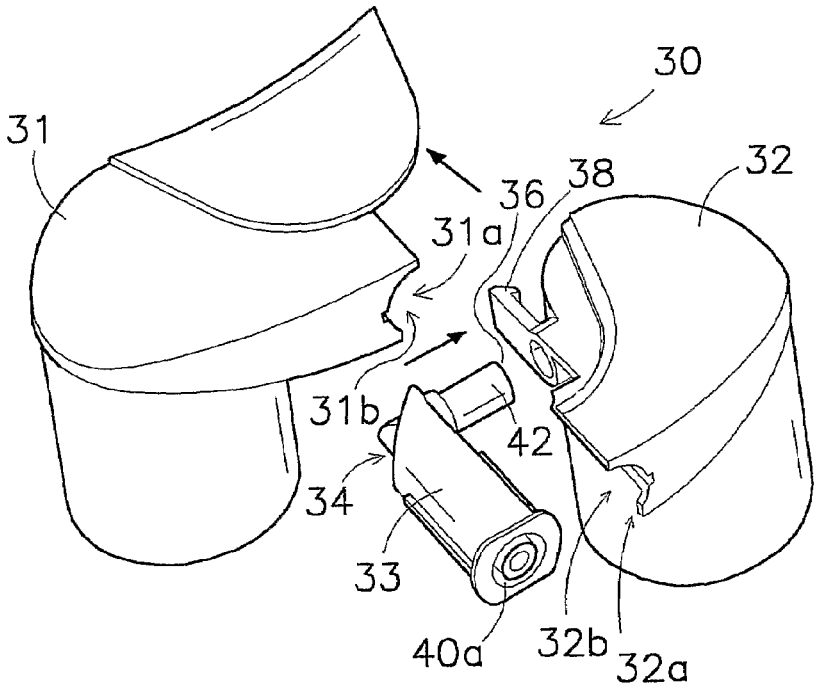
FIG. 4*b* shows how the assembly of FIG. 4*a* is assembled.

As can be seen in FIG. 4*b*, the space for accommodating the insert 33 is formed by the first and second pump operating buttons 31, 32, which each have a bearing surface 31*a*, 32*a* for the other pump operating button, the pump operating buttons each having a recess 31*b*, 32*b* at the bearing surface which forms part of the space for the insert 33.

The insert 33 fits between the pump operating buttons 31, 32 in a form-fitting manner in such a manner that the insert is secured against displacement by the pump operating buttons being coupled together. This coupling is achieved by means of resilient hook lip 38 on the button 32, which hooks behind hooking edge 39.

The insert 33 has a first dispensing duct 40 which is annular in section and which connects to the first dispensing duct 35 in the pump operating button 31 and which has an associated annular first dispensing nozzle 40*a*, and a central second dispensing duct 41 which connects to the second dispensing duct 37 in the pump operating button 32 and which is located inside the annular first dispensing duct 40 and has an associated central second dispensing nozzle 41*a*.

The part of the annular first dispensing duct 40 and the part of the central second dispensing duct 41 leading to the associated dispensing nozzles 40*a*, 41*a* extend substantially concentrically relative to one another.

A transverse duct 42 connects transversely to the central second duct 41, which transverse duct 42 connects to the second dispensing duct 37 in the pump operating button 32.

FIG. 4*a* shows that the first dispensing duct 35 in the pump operating button 31 connects to the annular first dispensing duct 40 in the insert 33 at substantially right angles.

It can be seen from FIG. 4*b* that the protruding tubular part of the transverse duct 42 is inserted in the button 32 and that the coupling between buttons 31, 32 is subsequently effected by a sliding movement in the direction of the bearing surfaces.

FIG. 4*c* shows the configuration of the dispensing nozzles 40*a*, 41*a*.

Figure 5A:
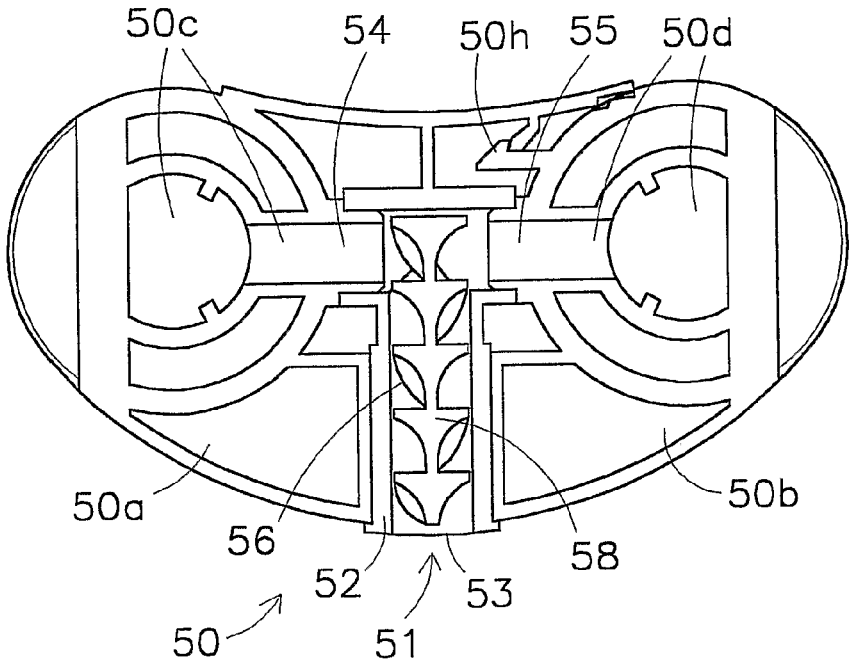
FIG. 5*a* shows a horizontal section of another embodiment of a pump operating button assembly with insert.

Now a variant of a pump operating button assembly 50 with insert 51 will be explained with reference to FIGS. 5*a*, 5*b*. The assembly furthermore comprises first and second pump operating buttons 50*a*, 50*b*, provided with first and second dispensing ducts 50*c*, 50*d*.

The insert 51 has a central part 52 with a common dispensing nozzle 53 at one end thereof and a first and second inlet 54, 55 at diametrically opposite locations at the other end, which inlets 54, 55 can be coupled (in this case via a plug coupling) to the first dispensing duct 50*c* and the second dispensing duct 50*d*, respectively.

Both inlets 54, 55 connect to the common dispensing duct 56, formed by the central part 52 which opens into the common dispensing nozzle 53.

A static mixer 58 is placed in the common dispensing duct 56, in this case having vanes. The static mixes 58 is a separate component which is fitted in the insert 51, for example by means of a click-fit edge.

Figure 5B:
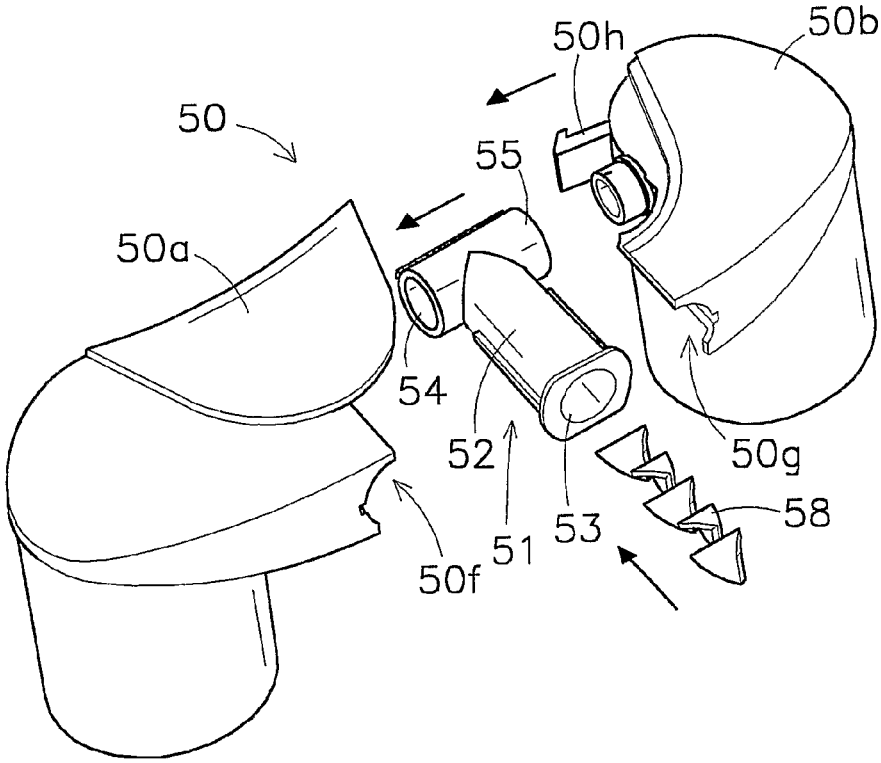
FIG. 5*b* shows how the assembly of FIG. 5*a* is assembled.

As is shown in FIG. 5*b*, the assembly 50 is assembled by moving the buttons 50*a*, 50*b* together transversely to their bearing surfaces 50*f*, 50*g*, the insert being locked between both buttons. In this case, button 50*b* is provided with a resilient hooking lip 50*h*, behind which the hooking edge of the button 50*a* engages.

It will be clear to those skilled in the art that with an alternative embodiment of the insert, for example using a suitably shaped and arranged separating wall in the duct 56, an embodiment is achieved in which the insert has a first dispensing duct which connects to the first dispensing duct in the pump operating button, and in which the insert has a second dispensing duct, which connects to the second dispensing duct in the pump operating button, the dispensing nozzles of the first and second dispensing duct in the insert lying next to one another in abutment in such a manner that a composite stream can be dispensed by the dispensing device.

With this alternative embodiment, it is conceivable that a first and second dispensing duct in the insert each have a single dispensing nozzle 60*a*, 60*b*, for example next to one another or one above the other. A possible embodiment thereof is shown in FIG. 6*a*. In this case, the first dispensing nozzle 60*a* is crescent-shaped and the second dispensing nozzle 60*b*, together with the crescent-shaped first dispensing nozzle 60*a*, essentially forms a circle.

In yet another version of the insert, the second dispensing duct branches into a plurality of second dispensing ducts, each having an associated second dispensing nozzle.

Figure 6B:
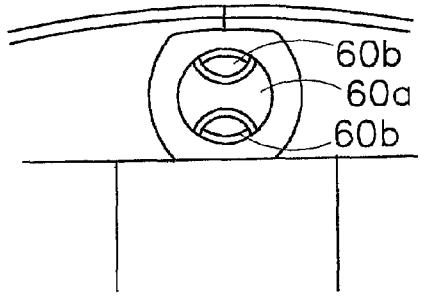
FIGS. 6*a*, 6*b*, 6*c* show alternative configurations of dispensing nozzles.
Figure 6A:
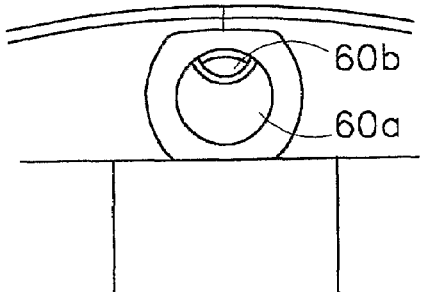

Thus, FIG. 6*b* shows an embodiment having two second dispensing nozzles 60*b* which, in this example, are situated diametrically opposite one another relative to a single first dispensing nozzle 60*a* of the first dispensing duct.

Figure 6C:
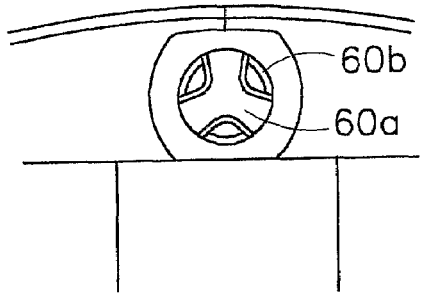

FIG. 6*c* shows the second dispensing duct branched into three second dispensing nozzles 60*b*, which are arranged at a substantially regular angular interval around the periphery of a single first dispensing nozzle 60*a*.

Now, a an exemplary embodiment without insert will be explained with reference to FIGS. 7*a*, 7*b*. This assembly 70 can also be used as an alternative for the assemblies mentioned above.

There is a first dispensing duct 70*c* in the first pump operating button 70*a* and a second dispensing duct 70*d* in the second dispensing duct 70*b*.

Each of the first and second pump operating buttons 70*a*, 70*b* has a bearing surface 70*f*, 70*g* which in this case is situated in the imaginary central plane between the pumps.

It can be seen at the button 70*a* that a recess 72 is present near the bearing surface 70*f*, in this case near the dispensing nozzle, in such a manner that the recess 72 forms part of a section of the dispensing duct 73 formed by the adjoining pump operating buttons 70*a*, 70*b* and in this example having a substantially rectangular dispensing nozzle 73*a*.

The pump operating button 70*b* has a protruding part 75 which extends into the recess 72 of the other pump operating button 70*a*, the dispensing duct 70*d* of this respective pump operating button 70*b* extending through the protruding part 75 and the protruding part 75 forming the dispensing nozzle 70*e* thereof. The protruding part 75 extends into the recess 72 of the other pump operating button near the end of the dispensing duct 73.

The buttons 70*a*, 70*b* are coupled using a sliding movement and fastened using the resilient hooking lip 78*a* of button 70*b* and hooking edge 78*b* of button 70*a*. The way in which the buttons 70*a*, 70*b* can be detached is indicated with an arrow in FIG. 7*b*.

Figure 7A:
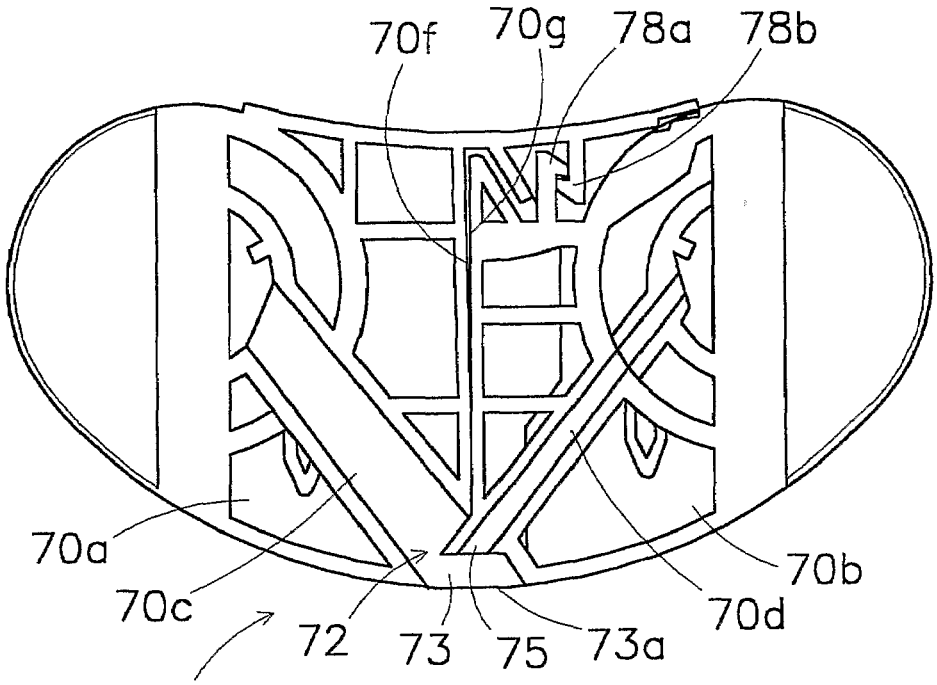
FIG. 7*a* shows a horizontal section of an alternative embodiment of a pump operating button assembly.
Figure 7B:
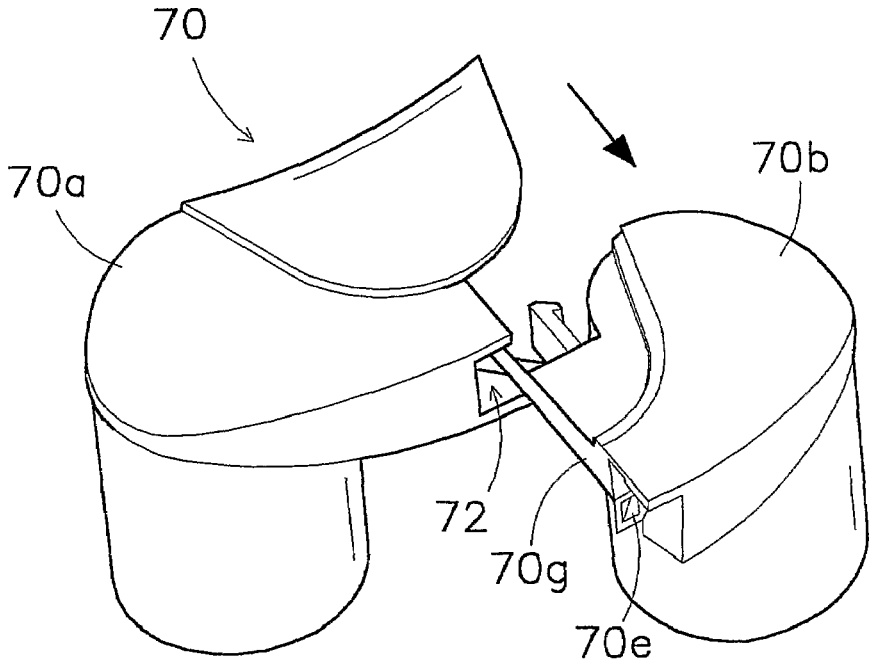
FIG. 7*b* shows how the assembly of FIG. 7*a* is assembled.

The solution according to FIGS. 7*a*, 7*b* results in a composite stream, for example a foam stream via duct 73 and a liquid, non-foaming stream via duct 70*d*. In this case, duct 73 has the largest bore.

Alternative embodiments with a recess in the one button and a protruding part with dispensing duct in the other button are shown in FIGS. 9*a*-9*d*, the design of the protruding part differing in each case.

Figure 9A:
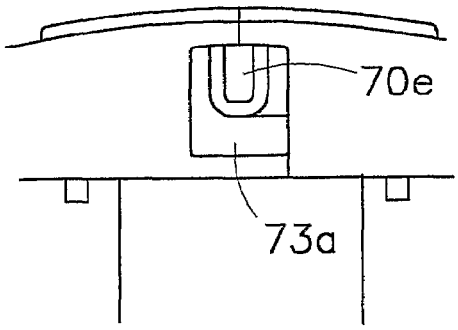
FIGS. 9*a*, 9*b*, 9*c* and 9*d* show alternative configurations of the dispensing nozzles.
Figure 9B:
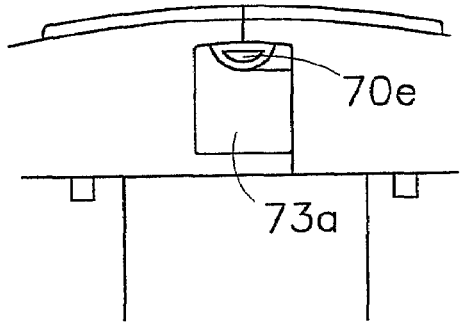

In FIG. 9*a*, the first dispensing nozzle 73*a* is substantially U-shaped and the second dispensing nozzle 70*e* is located in the open space of the U-shape.

Figure 9C:
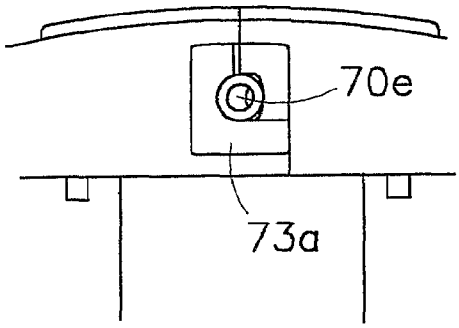

In FIG. 9*c*, the second dispensing nozzle 70*e* is situated in the centre of the first dispensing nozzle 73*a*.

Figure 9D:
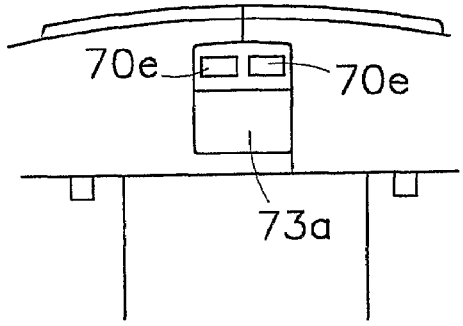

In FIG. 9*d*, the second dispensing duct branches into two adjoining second dispensing nozzles 70*e*, which are situated above the first dispensing nozzle 73*a*.

Figure 10:
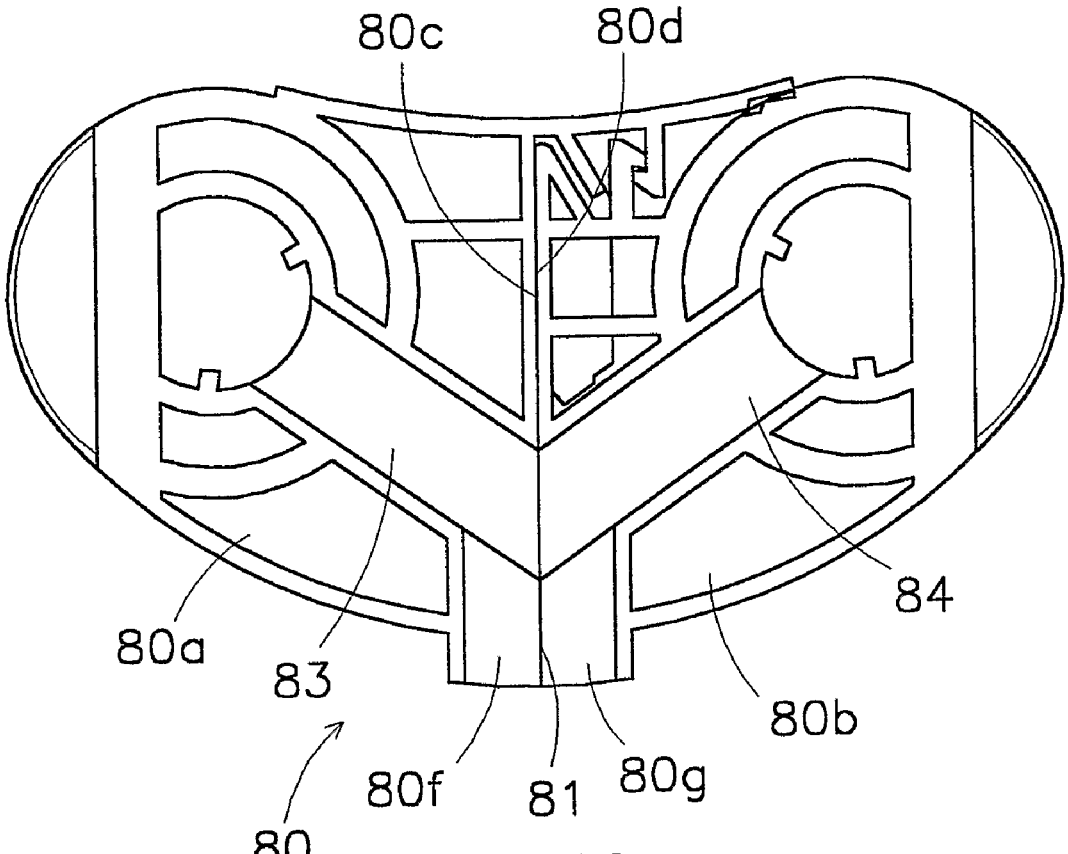
FIG. 10 shows a horizontal section of yet another alternative embodiment of a pump operating button assembly.

FIG. 10 shows a pump operating button assembly 80 with buttons 80*a*, 80*b*. In this case, both pump operating buttons 80*a*, 80*b* have a recess 80*f*, 80*g* at the bearing surface 80*c*, 80*d*, so that together, the recesses form a common dispensing duct 81. The dispensing ducts 83, 84 in the buttons 80*a*, 80*b* and connecting to the recesses 80*f*, 80*g* are directed at an angle relative to the common dispensing duct section 81.

In an embodiment (not shown), each pump operating button has its own dispensing duct and associated dispensing nozzle and both pumps are liquid pumps designed for dispensing liquid to the associated dispensing duct. In this case, an atomizing device, which are well known from the prior art, may be provided in one or both dispensing ducts, so that a mist is sprayed out of one or both dispensing nozzles. Of course, a mist could also be combined with a foam stream or a liquid stream.

What is claimed is:

1. Dispensing assembly comprising, a first and a second dispensing unit, preferably in an arrangement next to one another, which first and second dispensing unit each have a reservoir for accommodating a liquid substance as well as a manually operable first and second pump, respectively, attached to the reservoir, the dispensing assembly furthermore having a pump operating button assembly for jointly operating the first and second pump, the first pump connecting to a first dispensing duct in the pump operating button assembly and the second pump connecting to a second dispensing duct in the pump operating button assembly, which pump operating button assembly has at least one dispensing nozzle which is in communication with at least one dispensing duct in the pump operating button assembly for dispensing one or more dispensing products based on the substances emanating from the first and second dispensing units, in which the pump operating button assembly is formed by coupling together, optionally detachably, a first and a second pump operating button which, respectively, are part of the first and second dispensing unit, the first dispensing duct being provided in the first pump operating button and the second dispensing duct being provided in the second pump operating button, and in which the first and second pump operating buttons form a common space in which an insert is accommodated, which insert has a first inlet which connects to the first dispensing duct in the first pump operating button, and which insert has a second inlet which connects to the second dispensing duct in the second pump operating button, the insert forming one or more dispensing ducts connecting to the first and second inlets thereof and having one or more associated dispensing nozzles.

2. Dispensing assembly according to claim 1, in which the space for accommodating the insert is formed by the first and second pump operating buttons each having a bearing surface for the other pump operating button, the pump operating buttons each having a recess at the bearing surface which forms a part of the space for the insert.

3. Dispensing assembly according to claim 1, in which the insert fits between the pump operating buttons in a form-fitting manner, in such a way that the insert is secured against displacement by the pump operating buttons being coupled together.

4. Dispensing assembly according to claim 1, in which the insert has a first dispensing duct which is annular in section and which connects to the first dispensing duct in the pump operating button and which has an associated annular first dispensing nozzle, and a central second dispensing duct which connects to the second dispensing duct in the pump operating button and which is located inside the annular first dispensing duct and has an associated central second dispensing nozzle.

5. Dispensing assembly according to claim 4, in which the part of the annular first dispensing duct and the part of the central second dispensing duct leading to the associated dispensing nozzles extend substantially concentrically relative to one another.

6. Dispensing assembly according to claim 4, in which a transverse duct connects transversely to the central second duct, which transverse duct connects to the second dispensing duct in the pump operating button.

7. Dispensing assembly according to claim 4, in which the first dispensing duct in the pump operating button connects to the annular first dispensing duct in the insert at substantially right angles.

8. Dispensing assembly according to claim 1, in which the insert forms a common dispensing duct which connects to the first and second inlet of the insert and opens into the common dispensing nozzle.

9. Dispensing assembly according to claim 8, in which the insert is provided with a static mixer in the common dispensing duct.

10. Dispensing assembly according to claim 9, in which the static mixer is a separate component which is fitted in the insert.

11. Dispensing assembly according to claim 8, in which the insert has a central part with a common dispensing nozzle at one end thereof and the first and second inlet at diametrically opposite locations at the other end.

12. Dispensing assembly according to claim 1, in which the insert has a first dispensing duct, which connects to the first dispensing duct in the pump operating button, and in which the insert has a second dispensing duct, which connects to the second dispensing duct in the pump operating button, the dispensing nozzles of the first and second dispensing duct in the insert lying next to one another in abutment in such a manner that a composite stream can be dispensed by the dispensing device.

13. Dispensing assembly according to claim 12, in which the first and second dispensing duct in the insert each have a single dispensing nozzle, for example next to one another or one above the other.

14. Dispensing assembly according to claim 12, in which the second dispensing duct branches into a plurality of second dispensing ducts, each having an associated second dispensing nozzle.

15. Dispensing assembly according to claim 14, in which the second dispensing duct in the insert branches into two second dispensing ducts with two second dispensing nozzles, which are situated, for example, diametrically opposite one another relative to a single first dispensing nozzle or next to one another relative to a single first dispensing nozzle.

16. Dispensing assembly according to claim 14, in which the second dispensing duct branches into three or more dispensing nozzles arranged at a substantially regular angular interval around the periphery of a single first dispensing nozzle.

17. Dispensing assembly according to claim 1, in which the first and/or second inlet are formed by protruding tube parts of the insert which can be coupled to the dispensing duct in the associated pump operating button.

18. Dispensing assembly according to claim 1, in which the first pump is a foam-forming pump having a liquid pump part and an air pump part as well as a foam-forming feature where the pumped liquid and air are made to form a foam, and in which the second pump is a liquid pump.

19. Dispensing assembly according to claim 18, in which the bore of the first dispensing duct is larger than the bore of the second dispensing duct.

20. Dispensing assembly according to claim 1, in which the first pump and the second pump are each foam-forming pumps having a liquid pump part and an air pump part, as well as a foam-forming feature where the pumped liquid and air are made to form a foam.

21. A method of dispensing a dental care product comprising:

utilizing the dispensing assembly according to claim 1 for dispensing a dental care product.

22. Dispensing assembly comprising, a first and a second dispensing unit, preferably in an arrangement next to one another, which first and second dispensing unit each have a reservoir for accommodating a liquid substance as well as a manually operable first and second pump, respectively, attached to the reservoir, the dispensing assembly furthermore having a pump operating button assembly for jointly operating the first and second pump, the first pump connecting to a first dispensing duct in the pump operating button assembly and the second pump connecting to a second dispensing duct in the pump operating button assembly, which pump operating button assembly has at least one dispensing nozzle which is in communication with at least one dispensing duct in the pump operating button assembly for dispensing one or more dispensing products based on the substances emanating from the first and second dispensing units, in which the pump operating button assembly is formed by coupling together, optionally detachably, a first and a second pump operating button which, respectively, are part of the first and second dispensing unit, the first dispensing duct being provided in the first pump operating button and the second dispensing duct being provided in the second pump operating button, in which the first and second pump operating buttons each have a bearing surface for the other pump operating button, and in which at least one of the pump operating buttons has a recess at the bearing surface in such a manner that the recess forms part of a section of the dispensing duct formed by the adjoining pump operating buttons, and in which one of the pump operating buttons has a protruding part which extends into the recess of the other pump operating button, the dispensing duct of this respective pump operating button extending through the protruding part and the protruding part forming the dispensing nozzle thereof.

23. Dispensing assembly according to claim 22, in which the protruding part extends into the recess of the other pump operating button near the end of the dispensing duct.

24. Dispensing assembly according to claim 22, in which both pump operating buttons have a recess at the bearing surface, so that together, the recesses form a common dispensing duct.

25. Dispensing assembly according to claim 22, in which the dispensing ducts connecting to the recesses are directed at an angle relative to the common dispensing duct section.

26. A method of dispensing a dental care product comprising:

utilizing the dispensing assembly according to claim 22 for dispensing a dental care product.

* * * * *